United States Patent [19]

Stewen et al.

[11] 4,385,962

[45] May 31, 1983

[54] METHOD FOR THE PRODUCTION OF COKE

[75] Inventors: Wilhelm Stewen, Dortmund; Wilhelm Weskamp, Bochum, both of Fed. Rep. of Germany

[73] Assignee: Ruhrkohle Aktiengesellschaft, Fed. Rep. of Germany

[21] Appl. No.: 274,316

[22] Filed: Jun. 16, 1981

[30] Foreign Application Priority Data

Jun. 16, 1980 [DE] Fed. Rep. of Germany ..... 3022604

[51] Int. Cl.[3] ..... C10B 53/00; C10B 53/08; C10B 57/08

[52] U.S. Cl. ..... 201/6; 201/24; 201/42

[58] Field of Search ..... 201/6, 8, 20, 24, 42

[56] References Cited

U.S. PATENT DOCUMENTS

| | | | |
|---|---|---|---|
| 1,775,323 | 9/1930 | Runge | 201/24 |
| 3,883,399 | 5/1975 | Nire | 201/24 |
| 4,100,031 | 7/1978 | Kiritani et al. | 201/24 |
| 4,110,169 | 8/1978 | Suzuki et al. | 201/24 |
| 4,178,215 | 12/1979 | Kiritani et al. | 201/6 |
| 4,225,391 | 9/1980 | Perch et al. | 201/24 |

FOREIGN PATENT DOCUMENTS

| | | | |
|---|---|---|---|
| 2752479 | 5/1979 | Fed. Rep. of Germany | 201/24 |
| 50-10301 | 3/1975 | Japan | 201/6 |
| 2004298 | 3/1979 | United Kingdom | 201/24 |

*Primary Examiner*—Bradley Garris

*Attorney, Agent, or Firm*—Jordan B. Bierman; Linda Bierman

[57] ABSTRACT

Production of coke from coal is improved by mixing self-feeding coal with compacted non self-feeding coal prior to carrying out the coking process. Preferably, there is about 10% to about 60% by weight of the non self-feeding coal based on the total charge. Binders may be used and it is preferred that the non self-feeding coal be preheated to approximately 150° C. to 250° C. prior to mixing. In the event that an aqueous emulsion is used as the binder, the preheating step may be omitted. Coke of superior abrasion resistance is obtained by the foregoing method.

1 Claim, 1 Drawing Figure

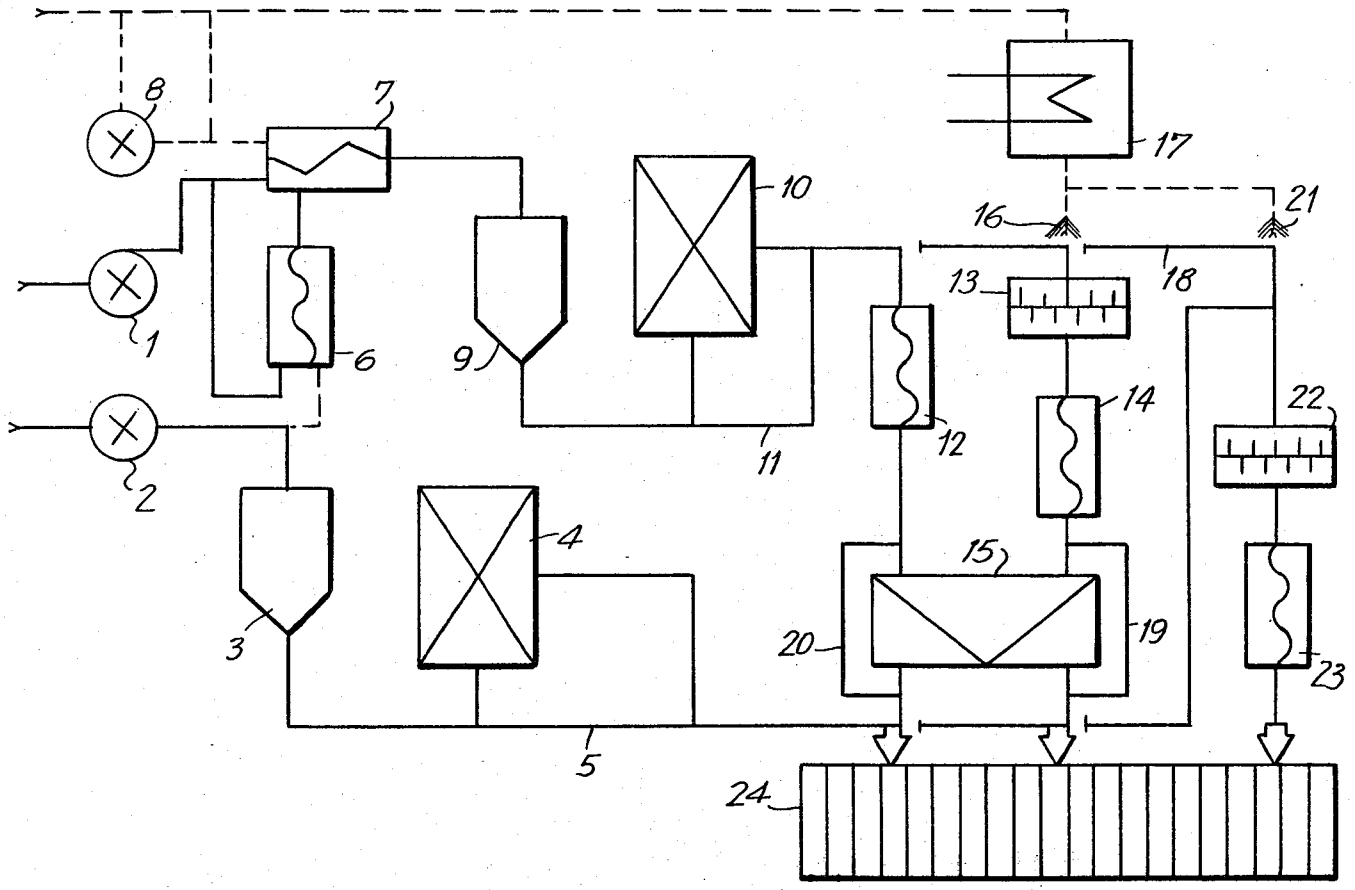
1
2
3
4
5
6
7
8
9
10
11
12
13
14
15
16
17
18
19
20
21
22
23
24

METHOD FOR THE PRODUCTION OF COKE

This application claims the priority of German Pat. No. P 30 22 604.1, filed June 16, 1980.

The present invention is directed to an improved method for producing coke; more specifically, for the preparation of coal mixtures to be charged into the coking oven which use non self-feeding coal.

There are two principal problems in the development of coke-plant engineering. On the one hand, it is desired to improve the quality of the finished product. On the other hand, the range of coal being used should be increased. In the latter case, attempts have been made to include the smaller or finer coal fractions in the coking process.

Before being charged into the oven, the coking coal has been typically ground to a grain size of between 0.5 and 10 mm. The fraction of the grains which is less than 0.5 mm is about 30 to 35%, and about 80 to 85% of the grains are smaller than 3.0 mm. Alternatively, the coking coal is mixed from correspondingly fine-grained products of normal coal processing. In recent decades, the finer fractions of the run-of-the-mine coal have substantially and definitely increased. It is, therefore, desirable to be able to make use of this fine coal.

However, it has been found that, when the fine-grain coal exceeds a certain limit, its apparent density decreases. As a result, the coking efficiency is diminished, because the capacity of the coke oven chamber decreases in direct proportion to the apparent density. Moreover, carbonization time is longer, because heat transfer in the pile goes down as the apparent density decreases.

This problem has been dealt with by making a portion of the coal charged coarser by agglomeration. Preferably sifter dust, flotation concentrate, and/or raw sludge are used for this purpose. In its complete phase, this area of technology includes heat drying followed by immediate agglomeration. There is an optimum grain size structure, and the charged coal, prepared by blending coals of different sizes is capable of assisting in the solution of both problems.

In addition to grain size structure, a further factor of importance in coking capacity is the maceral group analysis and the volatile components of the coal being charged. In other words, the optimum coking capacity can be represented, for example, as a function of the content of volatile components in the starting coal. This leads to the possibilities set forth in the journal "Glückauf-Forschungshefte", 4, 1966, pages 1 to 192. This journal describes the production of optimum coking coal mixtures by employing components which differ to grain size and in volatile constituents. The coking of non self-feeding coal is known, but the coking process is usually adversely influenced by the presence of such non self-feeding coal. For this reason, it has heretofore been possible to add only a very small proportions of non self-feeding coal to the charge mixtures.

It is an object of the present invention to increase substantially the range of components which can be mixed with self-feeding coal to form a suitable coking coal charge mixture.

In accordance with the present invention, the self-feeding coal and the non self-feeding coal are separately handled. If grinding is necessary, they are individually ground in known manner. The non self-feeding is preheated to approximatey 150° C. to 250° C. and formed into compacts. These compacts are mixed with the self-feeding coal shortly before introduction of the mixture into the coke oven. The compacts should comprise no more than 60%, preferably no more than 30%, of the mixture. For best results, the compacts should comprise a minimum of 10% of the total charged mixture.

In accordance with the present invention, the presence of both components complement each other in such a way that the optimum coking capacity can be reached. Contrary to the expectation of a reduction in coke quality, a clear improvement is obtained by processing the non self-feeding coal and increasing its coking power.

The compacting of the non self-feeding coal can be advantageously carried out by the use of a coal binder. Suitable binders are carbopitch, residues from coal oil processing, and oil refinery residues. When these binders are used, the conventional methods for determining the coking capacity are inadequate. As a result, it was not possible to anticipate, from the "measured" coking capacity, the suitability of the binders for the improvement of the ability of the total material to form coke.

After the binder has been added to the non self-feeding coal, the process of the present invention further provides feeding the coal to a mixer and/or kneader. The mixing and kneading is to insure homogeneous distribution of the binder in the coal; that is, to prevent accumulation or agglomeration. Once the mixing and kneading has been carried out, it has been found that the coal is readily storable.

In the preferred form of the invention, the compacting results in the production of nuggets or small rods. The preferred thickness is between 15 and 30 mm and the ratio of length to thickness is from 1:1 to 3:1.

In the accompanying drawing, constituting a part hereof and in which like reference characters indicate like parts, the single FIGURE is a flow diagram of the process of the present invention.

Non-caking (or non self-feeding) coal and coking (self-feeding) coal are separately introduced into mill 1 and 2. Alternatively, a single grinding mill can be used, provided each type of coal is charged separately into the mill and thereafter is sent to individual processing or holding stations for further treatment. Of course, if the run-of-the-mine coal is of suitable grain size, etc., the grinding step may be modified or even omitted altogether.

After grinding, the coking coal is fed into bunker 3 from which it can be drawn off continuously and placed in preheater 4. Preheater 4 raises the temperature of the coking coal to approximately 150° to 250° C. This preheating assists in the later mixture with warm compacts, thereby maintaining a high mixing capacity which leads to better filling of the interstitial volume when the compacts are added.

In the event that preheating of the coking coal is not necessary, as when an aqueous emulsion is used as the coal binder, preheater 4 can be bypassed by the use of channel 5.

The non-caking coal, after having been ground in mill 1, is transported to kneader 7. If desired, the non-caking coal can be first passed through mixer 6 before entering kneader 7. The latter serves to mix the ground non-caking charge with any needed auxiliary materials, such as binders. If necessary, these are first ground to a suitable size in mill 8 prior to entering kneader 7. If grinding is not needed, as in the case of liquid additives, mill 8 is bypassed.

If desired, some of the coking coal can be diverted to the non-caking coal through a bypass into mixer 6. The proportion of coking coal introduced into the non-caking coal at this point should not exceed 30%.

After leaving kneader 7, the additives have been uniformly distributed throughout the non-caking coal. This mixture is placed in bunker 9 from which it can be drawn off continuously into preheater 10. Preheater 10 drives off any water which may be present and which would otherwise interfere with the subsequent compacting of the mixture.

In accordance with the present invention, and contrary to generally recognized technology, the water is regarded as a parting liquid which interferes with the compacting operation, rather than as a binder. If the mixture is sufficiently dry, it may be possible to eliminate the use of preheater 10. A bypass 11 is provided for this possibility.

The non-caking coal then passes through mixer 12 and thence into compacter 15. Alternatively, the effluent from preheater 10 can be passed through double cross beating mixer 13, then into kneader 14, and finally to compacter 15. Preferably, compacter 15 is a double roll press or an extruder.

Compacter 15 preferably produces nuggets or little rods having a thickness of 15 to 30 mm. The ratio of length to width is from 1:1 to 3:1.

As an alternative or a supplement to introducing the additives to kneader 7, liquid additives can be sprayed on prior to the mixture entering mixer 13. In the event that the additives are initially solid, they may be liquified by introducing them into heater 17, and thence leading them to sprayer station 16 for application to the non-caking coal mixture. The application is preferably carried out by spraying the materials on the free-falling coal stream in a closed vessel.

In the event that compacting is unnecessary (as in the case of coal which comes from the mine in the proper size), the compacter may be bypassed by using one or more of bypasses 18, 19, and 20. If bypass 18 is used, the coal can be fed to spray station 21, double cross beating mixer 22, and kneader 23.

All of the coal streams resulting from the separate processing of non-caking (non self-feeding) coal are blended with the coking (self-feeding) coal prior to entering coke oven 24. The coal which arrives via spray station 21 is mixed with the coking coal prior to entering mixer 22 and kneader 23. Insofar as the other streams are concerned, this mixing takes place immediately prior to introduction into coke oven 24.

It is one of the features of the present invention that different components of the charged coal can be prepared. The object is to achieve separate grinding (if necessary) and a combination of preheating and compacting. The latter leads to the highest efficiency in the preparation of the charge mixtures. It has been found that the compacted coal has a pronounced swelling capacity as compared with that of the self-feeding coal which surrounds it in the mixture. This is extremely desirable for the preparation of improved quality coke.

The process of the present invention permits optimization of preparation of the coking charge which is specific for each type of coal. This makes the process relatively trouble-free and results in clearly improved characteristics of the finished coke. It is possible, as indicated herein, to use various successive process steps, or to bypass them in the event they are not necessary. As a result, the firmness of the compacts necessary for the desired coke quality can be achieved at minimum expense.

Furthermore, the present invention permits the use of the wide range of coal grades. By compacting the non self-feeding coal, compacts with special pyrolytic activities are produced; these swell to produce formed contact points during the coking process. A comparable effect is produced by preheating the charge coal to 250° C. These two steps will complement each other in the process.

The compacts in the mixture containing self-feeding coal should not exceed 60%. This same limitation applies to the proportion of all compacts in the final mixture. Compacting of the self-feeding coal should generally be minimized or avoided to the extent possible. It has been found that, by maintaining the compact proportion with the foregoing, a definite bulk rate increase is obtained. This favors the coking process and brings about a substantial increase in the productivity of the horizontal coking oven.

EXAMPLE

One hundred parts of coking coal are ground to a grain size of approximately 3 mm. Twenty parts of non self-feeding coal are mixed with about 4% binder (carbopitch), kneaded and preheated to approximately 200° C. The heated mixture is then further mixed and introduced into a double roll press which produces nuggets which were approximately 32 mm in length and 14 mm in width. Alternatively, small rods are formed of a length 52 mm and width 15 mm.

The two streams are blended together and then introduced into a horizontal coking oven of known design and heated in the usual manner. The resultant coke has excellent abrasion resistance and is of superior quality, even though a substantial percentage of non self-feeding coal has been used as a starting material.

The abrasion resistance of the coke is provided primarily by the compacts. The following tests are carried out with the nuggets and small rods as described above.

The $M_{10}$ and $M_{40}$ values indicate the abrasion resistance of the lump coal. During rotary movement of a micum drum, a slurry is formed, which remains as a residue on the screen after the test material has been poured out through a perforated plate. $M_{10}$ is the residue fraction which is less than 10 mm. $M_{40}$ is the residue which is over 40 mm in size.

It has been found that the improvement in abrasion resistance of the finished coke is analogous to the compressive strengths of the compacts; that is, the higher the strength of the compacts, the greater will be the quality improvement of the coke. In both cold and hot formed compacts, a definite and substantial increase in compressive strength is obtained. A corresponding improvement in the $M_{10}$ also occurs. The improvement of the $M_{10}$ values is attributed to the fact that, with the strength of the compacts, the internal gas pressure during pyrolosis of the partially briquetted charge mixtures is responsible for the swelling behavior, and has an important influence on the finished product. The results of these tests are set forth in the following table. The Oils 1 to 4 are residual oils from crude oil refining.

TABLE

| Additives | Distillate at 350° C. (%) | Base Mixture Gas flame coal/ semi-bituminous coal (2:1) + 20% fat coal | | | |
|---|---|---|---|---|---|
| | | 4% additive | | 6% additive | |
| | | $M_{10}$ | $M_{40}$ | $M_{10}$ | $M_{40}$ |
| Oil 1 | 45 | −4.6 | +6.0 | −5.3 | +6.7 |
| Oil 2 | 60 | −4.3 | +5.5 | −4.9 | +5.2 |
| Oil 3 | 90 | −1.9 | +3.1 | −2.5 | +3.9 |
| Oil 4 | 100 | −1.6 | +2.3 | — | — |
| Carbopitch EP 90 | | −4.7 | +6.1 | −6.9 | +7.9 |

The foregoing table indicates the selectively of various oils in their action on the coking properties of the charged base mixture. The small percentage of undesirable fines ($M_{10}$) evidences a notable and surprising improvement.

While only a limited number of specific embodiments of the foregoing invention have been expressly described, it is, nonetheless, to be broadly construed and not to be limited except by the character of the claims appended hereto.

We claim:

1. A process for the production of coke comprising (a) first grinding separately a binder selected from carbopitch, residues of coal oil processing and oil refinery residues; a non-self-feeding coal and a self-feeding coal, (b) then mixing said binder and said non-self-feeding coal to form a first mixture, (c) then kneading said first mixture, (d) then driving off water by heating the product of step (c) to a temperature of about 150° C. to about 250° C, (e) then further mixing said product, (f) then compacting said product in the form of nuggets or rod compacts, said compacts having a thickness of about 15 to about 30 mm and a length to thickness ratio of about 1:1 to about 3:1, (g) heating the ground self-feeding coal to about 150° C. to about 250° C., (h) mixing the product of step (g) with said compacts to form a second mixture such that said compacts comprise about 10% by weight to about 60% by weight of said second mixture, (i) then kneading said second mixture to form a charge and (j) then heating said charge in a coking oven to form coke, said charge being particles having an average particle size of about 0.5 to about 10.0 mm with about 30 to about 35% of said particles having a size less than about 0.5 mm and about 80 to about 85% of said particles having a size of less than about 3.0 mm.

* * * * *